US006532871B1

(12) United States Patent
Aurenty et al.

(10) Patent No.: US 6,532,871 B1
(45) Date of Patent: Mar. 18, 2003

(54) METHOD OF CONTROLLING IMAGE RESOLUTION ON A SUBSTRATE USING AN AUTOPHOBIC FLUID

(75) Inventors: Patrice M. Aurenty, Wood-Ridge, NJ (US); Roshanak Debeaud, Paris (FR)

(73) Assignee: Kodak Polychrome Graphics LLC, Norwalk, CT (US)

( * ) Notice: Subject to any disclaimer, the term of this patent is extended or adjusted under 35 U.S.C. 154(b) by 0 days.

(21) Appl. No.: 09/492,547

(22) Filed: Jan. 27, 2000

(51) Int. Cl.[7] ..... B41C 1/10; B41J 2/01

(52) U.S. Cl. ..... 101/465; 101/457; 347/96; 347/106

(58) Field of Search ..... 101/457, 462, 101/463.1, 465–467; 347/95, 96, 101, 105, 106; 516/198

(56) References Cited

U.S. PATENT DOCUMENTS

| | | | | |
|---|---|---|---|---|
| 3,877,372 A | | 4/1975 | Leeds | 101/465 |
| 4,278,467 A | | 7/1981 | Fadner | 106/2 |
| 4,368,961 A | | 1/1983 | Lin | 106/22 |
| 4,718,340 A | | 1/1988 | Love, III | 101/116 |
| 4,729,310 A | | 3/1988 | Love, III | 101/157 |
| 4,833,486 A | | 5/1989 | Zerillo | 346/1.1 |
| 4,854,969 A | | 8/1989 | Bassemir et al. | 106/2 |
| 5,266,222 A | | 11/1993 | Willis et al. | 252/49.006 |
| 5,312,654 A | | 5/1994 | Arimatsu et al. | 427/511 |
| 5,368,974 A | | 11/1994 | Walls et al. | 430/156 |
| 5,429,860 A | * | 7/1995 | Held et al. | 347/105 |
| 5,511,477 A | * | 4/1996 | Adler et al. | 101/401.1 |
| 5,562,762 A | | 10/1996 | Mrvos et al. | 106/22 |
| 5,609,993 A | * | 3/1997 | Hase et al. | 101/463.1 |
| 5,688,864 A | | 11/1997 | Goodwin | 524/858 |
| 5,738,013 A | | 4/1998 | Kellett | 101/463.1 |
| 5,788,754 A | | 8/1998 | Deardurff et al. | 106/31.58 |
| 5,820,932 A | * | 10/1998 | Hallman et al. | 101/465 |
| 5,851,674 A | | 12/1998 | Pellerite et al. | 428/421 |
| 5,852,075 A | | 12/1998 | Held | 523/161 |
| 6,033,740 A | * | 3/2000 | Oelbrandt et al. | 101/465 |
| 6,131,514 A | * | 10/2000 | Simons | 101/463.1 |

FOREIGN PATENT DOCUMENTS

| | | |
|---|---|---|
| EP | 101266 | 2/1984 |
| EP | 503621 | 9/1992 |
| EP | 591916 | 4/1994 |
| EP | 745568 | 7/1999 |
| JP | 01099851 | 4/1989 |
| JP | 08258397 | 10/1996 |
| JP | 8267902 | 10/1996 |
| WO | 9736980 | 10/1997 |
| WO | 0046034 | 8/2000 |
| WO | 0046036 | 8/2000 |

OTHER PUBLICATIONS

"Surfactants and Interfacial Phenomena" by Milton J. Rosen, John Wiley & Sons, 1978, pp. 184–189.*

Kloubek, "Calculation of Surface Free Energy Components of Ice According to its Wettability by Water, Chlorobenzene, and Carbon Disulfide", *J. Colloid Interface Sci.*, vol. 46, No. 2, 1974, pp. 185–190.

(List continued on next page.)

*Primary Examiner*—Stephen R. Funk
(74) *Attorney, Agent, or Firm*—Faegre & Benson, LLP

(57) ABSTRACT

A method of controlling the resolution of an image formed on a substrate comprises: (a) providing a substrate; (b) applying an image to the substrate by ink jetting onto the substrate a fluid composition comprising at least one surfactant, wherein the spreading of the fluid composition on the substrate in the presence of the surfactant is less than the spreading of the fluid composition on the substrate in the absence of the surfactant. The invention reduces the dot spreading which otherwise occurs when a substrate is imaged via ink jetting to prepare a printing plate.

47 Claims, 1 Drawing Sheet

OTHER PUBLICATIONS

Wolfram et al., "Effect of Surfactants on Wetting Dynamics in Solid/Liquid/Liquid Systems", *Ann. Univ. Sci. Budap. Rolando Eotvos Nominatae, Sect. Chim.,* vol. 15, 1979, pp. 199–206.

Pesach et al., "Marangoni Effects in the Spreading of Liquid Mixtures on a Solid", *Langmuir,* vol. 3, 1987, pp. 519–524.

Novotny et al., "Wetting Autophobicity", *J. Colloid Interface Sci.,* vol. 145, No. 2, 1991, pp. 355–361.

Biebuyck et al., "Autophobic Pinning of Drops of Alkanethiols on Gold", *Langmuir,* vol. 10, No. 12, 1994, pp. 4581–4587.

Reiter et al., "Autophobic Behavior of Polymers at Interfaces", *Proc. Rencontre Moriond,* 1995, pp. 57–66.

Shull, "Wetting Autophobicity of Polymer Melts", *Faraday Discuss.,* vol. 98, 1995, pp. 203–217.

Kerle et al., "Cross–Link–Induced Autophobicity in Polymer Melts: a Re–entrant Wetting Transition", *Europhys. Lett.,* vol. 38, No. 3, 1997, pp. 207–212.

Research Disclosure No. 39513, "Pigmented Ink Jet Inks Comprising Fluorinated Surfactants", Mar. 1997, pp. 145–146.

van der Wielen et al., "Autophobicity and Layering Behavior of Thin Liquid–Crystalline Polymer Films", *Langmuir,* vol. 14, No. 24, 1998, pp. 7065–7071.

Kerle et al., "Wetting and Autophobicity of a Polymer Melt on a Network of Itself", *Macromolecules,* vol. 31, No. 2, 1998, pp. 422–429.

Hamley et al., "Dewetting of Thin Block Copolymer Films", *J. Colloid Interface Sci.,* vol. 209, No. 1, 1999, pp. 255–260.

* cited by examiner

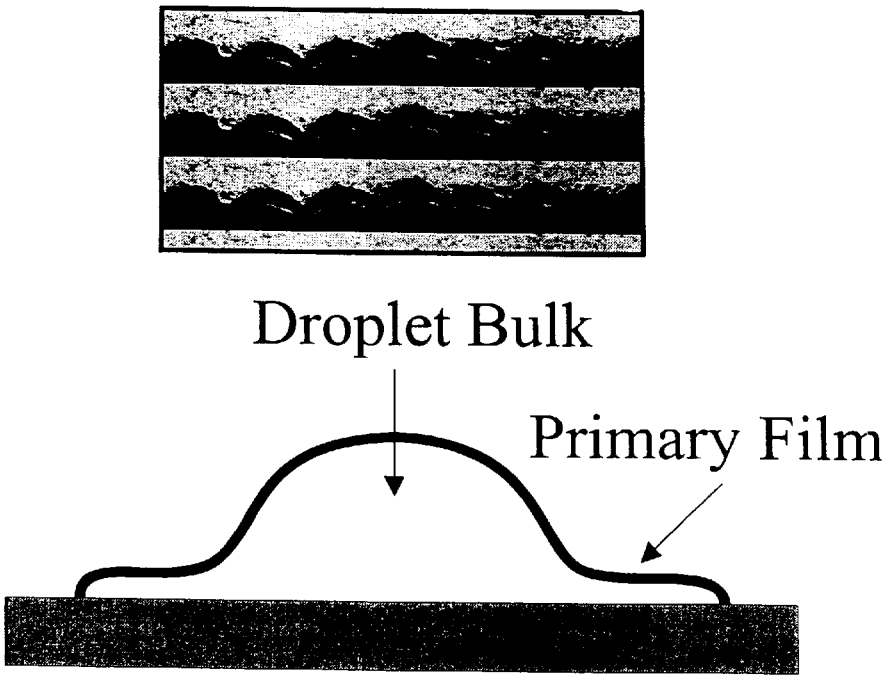
Figure 1: schematic representation of drop spreading by primary film.
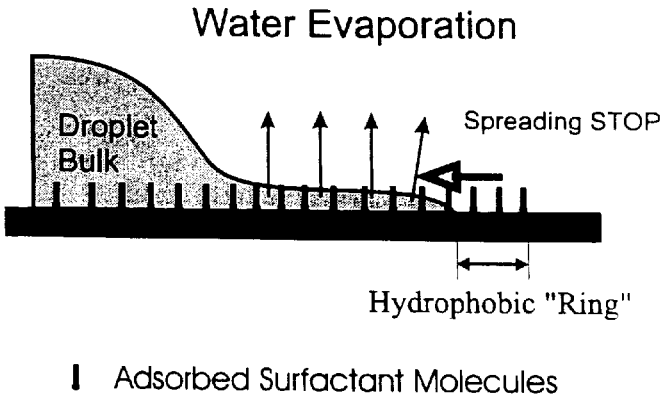
Figure 2: Autophobic

METHOD OF CONTROLLING IMAGE RESOLUTION ON A SUBSTRATE USING AN AUTOPHOBIC FLUID

FIELD OF THE INVENTION

This invention is directed to a method of controlling the resolution of an image formed on a substrate which advantageously minimizes fluid spreading on the substrate by use of an autophobic plate-imaging fluid, thereby avoiding the attendant low resolution and reduced image quality associated with such spreading. This invention is also directed to a method of preparing a printing plate in which such a fluid is used to image the plate by ink jetting onto a substrate to form an image area. The invention is also directed to such a printing plate for lithographic printing, and to a method of copying an image onto a medium.

BACKGROUND OF THE INVENTION

The offset lithographic printing process has long used a planographic printing plate having oleophilic image areas and hydrophilic non-image areas. The plate is commonly dampened before or during inking with an oil-based ink composition. The dampening process utilizes a fountain solution such as those described in U.S. Pat. Nos. 3,877,372, 4,278,467 and 4,854,969. When water is applied to the plate, the water will form a film on the hydrophilic non-image areas of the plate, but will contract into small droplets on the oleophilic plate image areas. When a roller carrying an oil-based ink composition is passed over the dampened plate, it will be unable to ink the non-image areas covered by the aqueous film, but will emulsify the water droplets on the water repellant image areas, which will then take up ink. The resulting ink image is then typically transferred ("offset") onto a rubber blanket, which is then used to print onto a medium such as paper.

It has been proposed to apply "direct" ink jet printing techniques to lithographic printing. For example, European Patent Publication No. 503,621 discloses a direct lithographic plate making method which includes jetting a photocurable fluid onto the plate substrate, and exposing the plate to ultraviolet radiation to harden the image area. An oil-based ink may then be transferred to the image area for printing onto a printing medium. There is no disclosure of the resolution of ink drops jetted onto the substrate, or the durability of the lithographic printing plate with respect to printing run length.

It has also been proposed to apply the direct ink jet printing techniques without the additional steps of chemical development. This approach advantageously results in lower production costs and a more environmentally acceptable printing process. However, in such techniques it is difficult to control the "dot spreading" of the fluid which forms the oleophilic ink-accepting portion on the printing plate substrate. Such spreading causes low printing image resolution and reduced image quality. For example, European Patent Application No. 591,916 discloses a water-based ink having a polymer containing anhydride groups which are thermally cross-linked with a hydroxy-functional polymer. This formulation is applied by ink-jetting at room temperature onto a room temperature substrate. However, this formulation does not achieve good control of dot spreading.

U.S. Pat. No. 4,833,486 discloses the apparatus and process for imaging a plate with a "hot melt" type of ink jet printer. The image is produced by jetting at high temperature a "phase change" type of ink which solidifies when it contacts the cooler substrate. The ink becomes instantaneously solid rather than remaining a liquid or gel which is thereafter cured to form a solid. However, such an ink does not provide good resistance to press run due to the wax-type nature of the ink formulation.

U.S. Pat. No. 5,738,013 discloses a "media/fluid" system used in the manufacture of lithographic plates. The media is a conventional hydrophilic substrate, and the fluid is based on a transition metal complex reactive component. The control of dot spreading via the viscosity differences of the fluid as a function of temperature is not addressed.

U.S. Pat. No. 5,688,864 and European Patent No. 745,568 disclose autophobic water repellent surface treatments. However, these disclosures are not directed to imaging a surface with an autophobic fluid via ink jetting to control dot spreading.

The use of fluorosurfactants in ink jet formulations is also known. For example, Jap. Pat. Appln. No. 08-267902 discloses the use of fluorosurfactants in ink jet formulations, primarily for the purpose of alleviating color-to-color bleeding.

U.S. Pat. No. 5,788,754 discloses a thermal ink jet ink comprising nonionic fluorosurfactants to alleviate color-to-color bleeding and to improve image quality. However, it is disclosed that larger dot sizes are desirable (col. 6, line 67), unlike the invention described here.

U.S. Pat. No. 5,852,075 discloses an ink jet ink comprising a mixture of at least one siloxane, surfactant and at least one fluorinated surfactant which exhibit excellent wetting on hydrophilic surfaces.

Research Disclosure No. 39513 (March 1997) discloses a pigmented ink jet ink comprising fluorinated surfactants to control surface tension to control droplet interaction on the receiver in multicolor ink jet printing. The disclosure is not directed to control of droplet spreading.

European Patent Appln. No. 101,266 discloses a printing method and apparatus where the image area is formed using a fluid which may comprise an anionic surfactant, or may comprise a polymer dissolved in toluene (pp. 20–22), and the fluid may be applied by ink jet (p. 50). The disclosure is not directed to reducing fluid droplet dot size or fluid droplet spreading on a substrate.

In view of the foregoing, it would be advantageous to provide a method of controlling spreading of fluids on substrates, particularly for printing plates. It is one object of this invention to provide such a method, in which an autophobic fluid composition is used for which the spreading on a substrate is reduced. It is another object of this invention to provide a method of preparing a printing plate which provides control of fluid composition spreading, and additionally provides good press run length. In the method of this invention, an autophobic fluid composition is applied by an ink jet printing apparatus to directly image a substrate to which the autophobic fluid composition is matched, thereby producing a printable medium, for example a printing plate. It is yet another object of this invention to provide such a printing plate.

Additional objects of this invention are to provide a method of imaging a printing plate, and a method of printing using such a plate.

SUMMARY OF THE INVENTION

The method of this invention is useful to provide a printing plate that avoids chemical development steps. More particularly, the method of this invention is useful to control the resolution of an image formed on a substrate, wherein the method comprises: (a) providing a substrate; (b) applying an image to the substrate by ink jetting onto the substrate a fluid composition comprising at least one surfactant, in which the dot size of the fluid composition on the substrate in the presence of the surfactant is less than the dot size of the fluid composition on the substrate in the absence of the surfactant.

In a preferred embodiment, the fluid composition of the method comprises at least one polymeric compound and an ionic surfactant, the fluid composition being applied to an interfacially matched substrate.

This invention is also directed to a method of preparing a printing plate by ink jetting onto the substrate a fluid composition. This invention is further directed to a method of forming an image on a substrate and to a method of copying an image onto a medium.

BRIEF DESCRIPTION OF THE DRAWINGS

FIG. 1 depicts a representation of a single droplet applied to a substrate which exhibits bits droplet spreading.

FIG. 2 depicts a representation of a single droplet applied to a substrate in which droplet spreading is controlled via an autophobic fluid composition.

DETAILED DESCRIPTION OF THE INVENTION

The invention here will control the spreading of droplets of fluid composition ink-jetted onto a substrate. In the absence of this invention, the substrate would exhibit very low contact angle for droplets of the fluid composition, allowing significant spreading of the droplets to occur and diminishing the resolution that could be achieved in using the substrate with the applied fluid composition as a printing plate. Here, the invention is a method to control spreading of the fluid droplets to improve image resolution by preparing an autophobic fluid composition that reduces spreading when used in combination with an interfacially matched substrate, as described below.

The autophobic fluid composition of this invention comprises a surfactant that reduces spreading of the fluid when applied to an interfacially matched substrate. This remarkable property works in, the opposite way that surfactants are conventionally used. Surfactants are conventionally used to reduce surface tension of a fluid to facilitate its wetting or spreading on a substrate. Here, the surfactant is used to prevent spreading of a fluid.

By "dot size" we mean the diameter after drying of an ink jetted fluid composition droplet on a substrate (see Example 1). By "drop size" we mean the diameter after drying of a fluid composition droplet which was dropped onto a substrate from a microsyringe (see Example 3).

Any conventional printing plate substrate, such as aluminum, polymeric film, and paper may be used as the printing plate substrate of this invention. The invention is not limited to printing plates, but can also be used to control fluid droplet spreading on any solid surface on which the fluid composition would otherwise spread, for example fabrics. A preferred substrate for printing plates is surface-roughened aluminum.

Printing plate substrates may be subjected to known treatments, such as electrograining, anodization, and silication, to enhance surface characteristics. Printing plate surfaces may carry a plurality of basic sites, such as sodium silicate groups. Alternatively, printing plate substrate surfaces may carry a plurality of acidic sites, such as sulfuric acid groups, phosphoric acid groups, dihydrogen phosphate groups, and acrylic acid groups. It is known in the art that a surface may also be amphoteric.

Particularly suitable substrates for use in this invention are given in Table 1. Preferably, such substrates are based on aluminum oxide and may be subjected to various conventional surface treatments as are well known to those skilled in the art. These treatments result in different roughnesses, topologies and surface chemistries, as summarized in Table 1.

TABLE 1

| Substrate Refs. | Surface Treatment | Interlayer Treatment | Surface Property |
|---|---|---|---|
| AA | Quartz Grained and Anodized | None | Acidic |
| EG-PVPA | Electrograined and Anodized | Polyvinyl phosphoric acid | Acidic |
| PF | Electrograined and Anodized | Sodium dihydrogen phosphate/Sodium fluoride | Acidic |
| EG-Sil | Electrograined and Anodized | Sodium Silicate | Basic |
| G20 | Electrograined and Anodized | Vinylphosphonic acid/acrylamide copolymer | Acidic/ Amphoteric |
| DS-Sil | Chemically Grained and Anodized | Sodium Silicate | Basic |
| PG-Sil | Pumice Grained and Anodized | Sodium Silicate | Basic |
| CHB-Sil | Chemically Grained, Anodized and Silicated | Sodium Silicate | Basic |

"AA" means "as anodized." The aluminum surface is first quartz grained and then anodized using DC current of about 8 A/cm$^2$ for 30 seconds in a $H_2SO_4$ solution (280 g/liter) at 30° C.

"EG" means "electrolytic graining." The aluminum surface is first degreased, etched and subjected to a desmut step (removal of reaction products of aluminum and the etchant). The plate is then electrolytically grained using an AC current of 30–60 A/cm$^2$ in a hydrochloric acid solution (10 g/liter) for 30 seconds at 25° C., followed by a post-etching alkaline wash and a desmut step. The grained plate is then anodized using DC current of about 8 A/cm$^2$ for 30 seconds in a $H_2SO_4$ solution (280 g/liter) at 30° C.

"PVPA" is a polyvinylphosphonic acid. The plate is immersed in a PVPA solution and then washed with deionized water and dried at room temperature.

"DS" means "double sided smooth." The aluminum oxide plate is first degreased, etched or chemically grained, and subjected to a desmut step. The smooth plate is then anodized.

"Sil" means the anodized plate is immersed in a sodium silicate solution. The coated plate is then rinsed with deionized water and dried at room temperature.

"PG" means "pumice grained." The aluminum surface is first degreased, etched and subjected to a desmut step. The plate is then mechanically grained by subjecting it to a 30% pumice slurry at 30° C., followed by a post-etching step and a desmut step. The grained plate is then anodized using DC current of about 8 A/cm$^2$ for 30 seconds in an $H_2SO_4$ solution (280 g/liter) at 30° C. The anodized plate is then coated with an interlayer.

"G20" is a printing plate substrate which is described in U.S. Pat. No. 5,368,974, the disclosure of which is incorporated herein by reference in its entirety.

"CHB" means chemical graining in a basic solution. After an aluminum substrate is subjected to a matte finishing process, a solution of 50 to 100 g/liter NaOH is used during graining at 50 to 70° C. for 1 minute. The grained plate is then anodized using DC current of about 8 A/cm$^2$ for 30 seconds in an $H_2SO_4$ solution (280 g/liter) at 30° C. The anodized plate is then coated with a silicated interlayer.

"PF" substrate has a phosphate fluoride interlayer. The process solution contains sodium dihydrogen phosphate and sodium fluoride. The anodized substrate is treated in the solution at 70° C. for a dwell time of 60 seconds, followed by a water rinse, and drying. The deposited dihydrogen phosphate is about 500 mg/m$^2$.

Those of ordinary skill in the art will understand that the "basic" and "acidic" descriptions of the surface chemistry of the printing plate substrates summarized above are relative terms. Thus, a "basic" surface will have a plurality of basic sites and acidic sites present, with the basic sites predominating to some degree. Similarly, an "acidic" surface will have a plurality of acidic sites and basic sites present, with the acidic sites predominating to some degree. The PG-silicated printing plate substrate appears to have a higher silicate site density than the double-sided printing plate substrate, and is more basic. The G20 printing plate substrate exhibits less acidic behavior than anodized only ("AA") printing plate substrates.

Illustrative examples of alkyl tail surfactants that may be used in preferred embodiments of this invention include sodium dodecylsulfate, isopropylamine salts of an alkylarylsulfonate, sodium dioctyl succinate, sodium methyl cocoyl taurate, dodecylbenzene sulfonate, alkyl ether phosphoric acid, N-dodecylamine, dicocoamine, 1-aminoethyl-2-alkylimidazoline, 1-hydroxyethyl-2-alkylimidazoline, and cocoalkyl trimethyl quaternary ammonium chloride, polyethylene tridecyl ether phosphate, and the like.

Illustrative examples of fluorosurfactants useful in preferred embodiments include the following non-exhaustive listing:

$F(CF_2CF_2)_{1-7}$—$(CH_2)_n$—$N^+R_3Cl^-$, $C_8F_{17}SO_2NHC_3H_6N^+(CH_3)_3I^-$, $F(CF_2CF_2)_{1-7}CH_2CH_2SCH_2CH_2CO_2^-Li^+$, $C_8F_{17}SO_2N(CH_2H_5)CH_2CO_2^-K^+$, $(F(CF_2CF_2)_{1-7}CH_2CH_2O)_{1,2}PO(O^-NH_4^+)_{1,2}$, $C_{10}F_{21}SO_3^-NH_4^+$, $C_6F_{13}CH_2CH_2SO_3H$ combined with $C_6F_{13}CH_2CH_2SO_3^-NH_4^+$, $F(CF_2CF_2)_{1-7}CH_2CHO[CH_2COO]CH_2N^+R_2CH_2COO^-$, $R^{}SO_3^-$, $C_8F_{17}SO_2N(C_2H_5)(CH_2CH_2O)_xCH_3$, $F(CF_2CF_2)_{1-7}CH_2CH_2O(CH_2CH_2O)_yH$, and $F(CF_2CF_2)_{1-7}CH_2CH_2O(CH_2CH_2O)_zH$, where R contains an ammonium functional group, y<z, and y or z=0 to about 25.

Illustrative examples of fluorosurfactants useful in preferred embodiments of the present invention and their commercial trade names are set forth in Table 2.

TABLE 2

Fluorosurfactants useful in preferred embodiments

| Trade Name | Chemical Structure | Type |
|---|---|---|
| Zonyl FSD | $F(CF_2CF_2)_{1-7}$-alkyl-$N^+R_3Cl^-$ | Cationic |
| Fluorad FC-135 | $C_8F_{17}SO_2NHC_3H_6N^-(CH_3)_3I^-$ | Cationic |
| Zonyl FSA | $F(CF_2CF_2)_{1-7}CH_2CH_2SCH_2CH_2CO_2$_$Li^+$ | Anionic |
| Fluorad FC-129 | $C_8F_{17}SO_2N(C_2H_5)CH_2CO_2^-K+$ | Anionic |
| Zonyl FSP | $(F(CF_2CF_2)_{1-7}CH_2CH_2O)_{1,2}PO(O^-NH_4^+)_{1,2}$ | Anionic |
| Zonyl FSJ(1) | $(F(CF_2CF_2)_{1-7}CH_2CH_2O)_{1,2}PO(O^-NH_4^+)_{1,2}$ | Anionic |
| Fluorad FC-120 | $C_{10}F_{21}SO_3^-NH_4^+$ | Anionic |
| Zonyl FS-62 | $C_6F_{13}CH_2CH_2SO_3H$, $C_6F_{13}CH_2CH_2SO_3^-NH_4^+$ | Anionic |
| Zonyl FSK | $F(CF_2CF_2)_{1-7}CH_2CHOAcCH_2N^+R_2CH_2COO^-$ | Amphoteric |
| Fluorad FC-100(2) | $R^{**}SO_3^-$ | Amphoteric |
| Fluorad FC-170C | $C_8F_{17}SO_2N(C_2H_5)(CH_2CH_2O)_x$ | Nonionic |
| Fluorad FC-171 | $C_8F_{17}SO_2N(C_2H_5)(CH_2CH_2O)_xCH_3$ | Nonionic |
| Zonyl FSO(3) | $F(CF_2CF_2)_{1-7}CH_2CH_2O(CH_2CH_2O)_yH$ | Nonionic |
| Zonyl FS-300(3) | $F(CF_2CF_2)_{1-7}CH_2CH_2O(CH_2CH_2O)_zH$ (z > y) | Nonionic |

(1)FSJ also contains a nonfluorinated surfactant.
(2)R** contains an ammonium function.
(3)y or z = 0 to about 25.

ZONYL surfactants are commercially available from E. I. du Pont de Nemours & Co. and have a distribution of perfluoroalkyl chain length. FLUORAD surfactants are commercially available from 3M Company and have a narrow distribution of the hydrophobic chain length.

Illustrative siliconated surfactants useful in preferred embodiments include the following non-exhaustive listing: polyether modified poly-dimethyl-siloxane, silicone glycol, polyether modified dimethyl-polysiloxane copolymer, and polyether-polyester modified hydroxy functional polydimethyl-siloxane.

In one particularly preferred embodiment, the surfactant is anionic and is preferably selected from the group consisting of sodium dodecyl sulfate, sodium dioctyl sulfosuccinate, $F(CF_2CF_2)_{1-7}CH_2CH_2SCH_2CH_2CO_2^-Li^+$, $C_8F_{17}SO_2N(C_2H_5)CH_2CO_2^-K^+$, $(F(CF_2CF_2)_{1-7}CH_2CH_2O)_{1,2}PO(O^-NH_4^+)_{1,2}$, $C_{10}F_{21}SO_3^-NH_4^+$, $C_6F_{13}CH_2CH_2SO_3H$, $C_6F_{13}CH_2CH_2SO_3^{-NH}{}_4^+$, and mixtures thereof.

In another particularly preferred embodiment, the surfactant is cationic and is preferably selected from the group consisting of cocoalkyl trimethyl quaternary ammonium chloride, N,N-dioctyl-N,N-dimethylammonium chloride, $F(CF_2CF_2)_{1-7}$—$(CH_2)_n$—$N^+R_3Cl^-$, where R is hydrogen or methyl and n is less than twelve, $C_8F_{17}SO_2NHC_3H_6N^+(CH_3)_3I^-$, and mixtures thereof.

The fluid composition employed in this invention is autophobic. As used in this application and in the appended claims, "autophobic" refers to a fluid that initially wets the substrate surface, but subsequent to initial wetting, the exterior portion of each droplet of fluid causes the underlying substrate surface to repel the remaining portion of the fluid droplet, thereby reducing the spreading of the droplet. The autophobic fluid composition can be aqueous or non-aqueous.

The autophobic fluid composition of this invention comprises a surfactant that is interfacially matched to the substrate on which the fluid composition is applied, and is compatible with any polymer component of the fluid composition. By "interfacial matching" of the surfactant to the substrate, we mean that an anionic surfactant is used in a fluid composition that is applied to an acidic substrate, and that a cationic surfactant is used in a fluid composition that is applied to a basic substrate. By "compatible with any polymer component," we mean that an anionic surfactant is used in a fluid composition that comprises an anionic polymer component, and that a cationic surfactant is used in a fluid composition that comprises a cationic polymer component. Without intending to be bound by any one particular theory, the droplet of fluid composition on the substrate spreads initially in a primary film around the droplet. In theory, the surfactant in the primary film of an autophobic fluid of this invention binds to the substrate and forms a ring around the autophobic fluid composition droplet on the substrate that repels the bulk of the fluid composition droplet, thereby reducing the spreading of the droplet relative to a non-autophobic fluid.

In preferred embodiments, a printing plate is made by imagewise applying an autophobic fluid composition comprising an ink-receiving layer compound to a substrate, in which the ink-receiving layer compound forms an oleophilic ink-receiving layer. The ink-receiving layer compound used in the fluid composition may be any compound, including a thermoplastic, an elastomeric polymer, or a biopolymer. In preferred embodiments, the ink-receiving layer compound may be a monomeric compound, or it may be a polymeric compound. If it is a polymeric compound, it may be a homopolymer, copolymer, terpolymer, and the like. By "copolymer" we mean any polymer comprised of more than one type of monomer, prepared in a copolymerization. By "terpolymer" we mean a polymer consisting essentially of three types of monomers, prepared in a copolymerization. Thus, a copolymer can include a terpolymer.

Illustrative, but not limiting, examples of the ink-receiving layer compound useful in matching with anionic surfactants in the fluid composition include acidic polymeric compounds such as poly(acrylic acid), poly(methacrylic acid), poly(maleic acid), poly(maleic anhydride), poly (fumaric acid), poly(fumaric anhydride), poly(styrene-co-acrylic acid), poly(styrene-co-maleic acid), poly(styrene-co-fumaric acid), polymers of ethylenically unsaturated sulfonic acid, polymers of sulfonated styrene, and mixtures or derivatives thereof.

Illustrative, but not limiting, examples of the ink-receiving layer compound useful in matching with cationic surfactants in the fluid composition include basic polymeric compounds such as basic copolymers of styrene, polyamides, poly(vinylpyridine), basic copolymers of urethane, poly(dialkylaminoalkyl methacrylate), poly(2-vinylpyridine), poly(4-vinylpyridine), copolymers of 2-vinylpyridine, copolymers of 4-vinylpyridine, poly (ethylimidazolidone methacrylate), 2-pyridylethyl trimethoxysilane, copolymers of dimethylaminoethyl methacrylate/methyl methacrylate, terpolymers of dimethylaminoethyl methacrylate/methyl methacrylate/ethylimidazolidone methacrylate, copolymers of 4-vinylpyridine/methyl methacrylate/hydroxyethyl acrylate/ethyl acrylate, and mixtures or derivatives thereof.

In preferred embodiments, a printing plate is made by applying a fluid composition to the substrate by ink jetting, typically with well known ink jet printing equipment. The substrate is imaged with the fluid composition so that after drying, an ink-receiving layer is formed in the desired image on the surface of the substrate that can be used for printing. Any printing medium can be used, for example paper, fabrics, plastic, aluminum, and metals.

An imaged substrate prepared by imagewise applying a fluid composition to a substrate could also be used, for example, as a precursor for a printed circuit board in which conductive metals are deposited onto the imaged substrate.

The following examples are given to illustrate preferred embodiments of the present invention and are not intended to limit the invention in any way. It should be understood that the present invention is not limited to the above-mentioned embodiments. Numerous modifications can be made by one skilled in the art having the benefits of the teachings here. Such modifications should be taken as being encompassed within the scope of the present invention as set forth in the appended claims.

EXAMPLE 1

A fluid composition, R2910-85-5, was prepared having 0.5 weight percent anionic surfactant ZONYL FSP, 0.05 weight percent SURFYNOL SE-F (surfactant needed for ink jetting), and 99.45 weight percent deionized water. The fluid composition was ink jetted with an EPSON 740 printer onto an acidic AA substrate (Table 1). After drying without processing or curing, the image on the substrate did not rub off with a pad impregnated with ink and water. This printing plate was used in an accelerated press trial of 12,500 impressions on paper and no evidence of image wear was observed. Thus, the plate was suitable for very low volume printing. The accelerated press trial used a rubber transfer blanket of high hardness that accelerates wear of the printing plate.

Dot size was measured with an optical microscope and IMAGE PRO software as an average of at least 30 dots which were ink jetted onto a substrate and dried. For fluid composition R2910-85-5, the dot size was 23 micrometers.

A similar fluid composition, R2910-85-6, was prepared having 1.0 weight percent anionic surfactant ZONYL FSP, 0.05 weight percent SURFYNOL SE-F (surfactant needed for ink-jetting), and 98.95 weight percent deionized water. This fluid composition was used in an accelerated press trial of 15,000 impressions on paper, and no evidence of image wear was observed. The dot size for this fluid composition was 19.9 micrometers. The dot sizes for the fluid compositions of this example were substantially smaller than for a non-autophobic fluid composition.

A printing plate that survives an accelerated press trial of fifteen thousand impressions with no evidence of wear of the ink-receiving layer on the substrate or in the printed impressions is suitable for a variety of commercial applications. Such a plate is called suitable for "low volume" printing since a press run of fifteen thousand is a low volume commercial run. It should be noted that passing an accelerated press trial of fifteen thousand impressions with no evidence of wear means that the plate is capable of a substantially longer press run than fifteen thousand under ordinary commercial printing conditions.

A printing plate that shows evidence of wear of the ink-receiving layer on the substrate or in the printed impressions for a run of about one thousand to less than about fifteen thousand impressions is a plate that is suitable for "very low volume" printing. A printing plate that shows evidence of wear of the ink-receiving layer on the substrate or in the printed impressions for a run of less than about one thousand impressions is a plate that is not suitable for commercial printing, although it has utility to form a lithographic image.

EXAMPLE 2

A drop test was used to measure spreading behavior of the fluid composition on a substrate plate as follows. A 10 $\mu$l chromatographic microsyringe with a flat needle was filled with the fluid composition. A droplet was formed at the needle extremity and dropped on the surface from a height of about 3 mm. After deposition of 4 to 5 drops, the plate was dried and the resulting dot diameter was measured and averaged. In case of "ovoid" spreading the smaller diameter was recorded. Drop volume was constant, within 10%. A drop test was used to measure the spreading of fluid compositions on various substrates, as illustrated in Table 3.

TABLE 3

Drop test (mm) for fluid compositions on various substrates.

| Plates | | Acidic | | Basic |
|---|---|---|---|---|
| Resin | Surfactant | AA | PF | EG-Sil |
| Anionic Resin R2809-64* | Standard: NO SURFACTANT | 5 | 20 | 6 |
| | Anionic Surfactant | | | |
| 3 wt % | 0.5 wt % FSA | 2 | 3 | 8 |
| | 0.5 wt % FSP | 2 | 3 | 10 |
| | 0.5 wt % FC120 | 4 | 10 | 8.5 |
| | Non Ionic surfactant | | | |
| | 1 wt % FC170C | 45 | 10 | 8 |
| Cationic Resin R2930-3** | Standard: NO SURFACTANT | 4.5 | 7 | 5 |
| | Cationic Surfactant | | | |
| 3 wt % | 1 wt% Ammonium FC135 | 4 | 6.5 | 2.5 |
| | Non Ionic surfactant | | | |
| | 1 wt % FC170C | 5.5 | 7.5 | 5 |

*Prepared from Fumaric Filtrez 532, a poly-fumaric acid (Akzo Nobel Resins).
**Partially neutralized copolymer prepared from dimethylaminoethyl methacrylate and methyl methacrylate in methyl isobutyl ketone, initiated with 0.8% VAZO-88 1,1'-azobicyclohexanecarbonitrile; solids, 26.75%; viscosity, 480 centipoise at 25° C. and 2.5 rpm; pH 6.04; molecular weight 20,900; amine number 109.

As shown in Table 3, drop size was substantially reduced for the combination anionic surfactant, anionic resin, and acidic substrate. Drop size was also substantially reduced for the combination cationic surfactant, cationic resin, and basic substrate. Drop size was also reduced for the combination nonionic surfactant, anionic resin, and acidic substrate.

EXAMPLE 3

A fluid composition, R2884-157, was prepared having 3 weight percent ethylimidazolidone methacrylate copolymer, R2930-13 (see Example 5), 0.05% weight percent cationic surfactant FLUORAD FC-135, 2 weight percent glycerol humectant, 0.3 weight percent SURFYNOL SE-F (nonionic surfactant), 0.4 weight percent FOAMEX antifoamant, and 94.25 weight percent deionized water. The fluid composition was ink jetted with an EPSON 440 printer onto an EG-Sil substrate (Table 1). After drying without processing or curing, the image on the substrate did not rub off with a pad impregnated with ink and water. This printing plate was used in an accelerated press trial of 15,000 impressions on paper, and no evidence of image wear was observed. Thus, the plate was suitable for low volume printing. The accelerated press trial used a rubber transfer blanket of high hardness that accelerates wear of the printing plate.

When the cationic surfactant FLUORAD FC-135 was present in the fluid composition, the dot size was 32.1 micrometers, which was reduced by 34% from the dot size of 48.7 micrometers measured for the same fluid composition, but without the cationic surfactant FLUORAD FC-135. The ink jetted dot size for this fluid composition was nearly the same with and without FC-135 on acidic substrates AA and PF.

EXAMPLE 4

A fluid composition, R2884-156, was prepared having 3 weight percent 4-vinylpyridine copolymer, R2930-14 (see Example 6), 0.05% weight percent cationic surfactant FLUORAD FC-135, 2 weight percent glycerol humectant, 0.3 weight percent SURFYNOL SE-F (nonionic surfactant), 0.4 weight percent FOAMEX antifoamant, and 94.25 weight percent deionized water. The fluid composition was ink jetted with an EPSON 440 printer onto an EG-Sil substrate (Table 1). After drying without processing or curing, the image on the substrate did not rub off with a pad impregnated with ink and water. This printing plate was used in an accelerated press trial of 15,000 impressions on paper, and no evidence of image wear was observed. Thus, the plate was suitable for low volume printing. The accelerated press trial used a rubber transfer blanket of high hardness that accelerates wear of the printing plate.

When the cationic surfactant FLUORAD FC-135 was present in the fluid composition, the ink-jetted dot size was 37 micrometers, which was reduced by 22% from the dot size of 47.6 micrometers measured for the same fluid composition, but without the cationic surfactant FLUORAD FC-135.

EXAMPLE 5

A copolymer, R2930-13, was prepared from methyl methacrylate (MMA), 2-(dimethylamino)ethyl methacrylate (DMAEMA), and ethylimidazolidone methacrylate (MEIO), in the ratio 72:23:5. A 2L roundbottom flask was charged with 240 g methyl isobutyl ketone (MIBK), and the solvent was stirred and heated to reflux under nitrogen. Separate addition funnels were charged with, (1) a blend of 57.5 g DMAEMA, 62.5 g Norsocryl 100 (Elf-Atochem: 20% MEIO, 80% MMA), and 130 g MMA, and (2) a solution of 2 g VAZO 88 (DuPont) in 25 g MIBK. Dual addition was carried out for 2.5 hours at reflux, and then the large funnel rinsed into the batch with 20 g MIBK. An hour later, an initiator post-add of 0.25 g VAZO 88 in 5 g MIBK was made. Two hours after the post-add, the apparatus was converted from reflux to distillation, and about 90 g distillate removed before heating was halted. At below 85°, a blend of 15.2 g formic acid and 610 g water was added, and the opaque mixture heated again. Azeotropic distillation began, returning the lower layer to the reactor until the batch temperature reached 95°. This stage continued until the batch reached 100° and no more upper layer was collecting. As the batch cooled, another 30 g water was added with mixing. Typical recovery was 810 g, pH 6.0, total solids 27%, Brookfield viscosity 1450 centipoise (25°, 20 rpm).

EXAMPLE 6

A 4-vinylpyridine copolymer, R2930-14, was prepared from methyl methacrylate (MMA), 4-vinylpyridine (4-VP), ethylacrylate (EA), and hydroxyethylacrylate (HEA) in the ratio 45.6:26.7:14.83:12.87. A 2L roundbottom flask was charged with 240 g methyl isobutyl ketone (MIBK), and the solvent was stirred and heated to reflux under nitrogen. Separate addition funnels were charged with, (1) a blend of 114 g MMA, 66.75 g 4-VP, 37.08 g EA, and 32.18 g HEA, and (2) a solution of 2 g VAZO 88 (DuPont) in 25 g MIBK. Dual addition was carried out for 2.5 hours at reflux, and then the large funnel rinsed into the batch with 20 g MIBK. During the next 3.5 hours at reflux, two small initiator post-adds of 0.25 g VAZO 88 in 5 g MIBK and 0.16 g VAZO 88 in 5 g MIBK were made. The apparatus was converted from reflux to distillation, and about 136 g distillate removed before heating was halted. At below 85°, a blend of 21.9 g formic acid and 610 g water was added, and the heterogeneous mixture was heated again while diluting with 40 g water. Azeotropic distillation was carried out until very little upper layer was collecting, at about 99°–100°. Lower layer collected at less than 95° was returned to the reactor. the batch reached 100°. As the opaque, viscous batch cooled, it was diluted with 70 g n-propanol and 7 g additional formic acid. Typical recovery was 948 g, pH 4.2, total solids 25%, Brookfield viscosity 1968 centipoise (25°, 20 rpm).

The invention claimed is:

1. A method of controlling the resolution of an image formed on a substrate, comprising:

(a) providing a substrate; and (b) applying an image to the substrate by imagewise directly applying upon the substrate a fluid composition comprising at least one surfactant which is interfacially matched to the substrate, in which the dot size of the fluid composition on the substrate in the presence of the surfactant is less than the dot size of the fluid composition on the substrate in the absence of the surfactant, wherein an ink-absorbing layer is not applied to the substrate.

2. The method of claim 1, in which the dot size of the fluid composition on the substrate in the presence of the surfactant is about or less than 90% of the dot size of the fluid composition on the substrate in the absence of the surfactant.

3. The method of claim 1, in which the dot size of the fluid composition on the substrate in the presence of the surfactant is about or less than 80% of the dot size of the fluid composition on the substrate in the absence of the surfactant.

4. The method of claim 1, in which the dot size of the fluid composition on the substrate in the presence of the surfactant is about or less than 70% of the dot size of the fluid composition on the substrate in the absence of the surfactant.

5. A method of controlling the resolution of an image formed on a substrate, comprising:

(a) providing a basic substrate; and (b) applying an image to the substrate by imagewise directly applying upon the substrate a fluid composition comprising an ink-receiving layer compound and a cationic surfactant, in which the dot size of the fluid composition on the substrate in the presence of the surfactant is less than the dot size of the fluid composition on the substrate in the absence of the surfactant, wherein an ink-absorbing layer is not applied to the substrate.

6. The method of claim 5, in which the ink-receiving layer compound is selected from the group consisting of basic copolymers of styrene, polyamide, poly(vinylpyridine), basic copolymers of urethane, poly(dialkylaminoalkyl methacrylate), poly(2-vinylpyridine), poly(4-vinylpyridine), copolymers of 2-vinylpyridine, copolymers of 4-vinylpyridine, poly(ethylimidazolidone methacrylate), 2-pyridylethyl trimethoxysilane, copolymers of dimethylaminoethyl methacrylate/methyl methacrylate, terpolymers of dimethylaminoethyl methacrylate/methyl methacrylate/ethylimidazolidone methacrylate, copolymers of 4-vinylpyridine/methyl methacrylate/hydroxyethyl acrylate/ethyl acrylate, and mixtures thereof.

7. The method of claim 5, in which the cationic surfactant is $C_8F_{17}SO_2NHC_3H_6N^+(CH_3)_3I^-$.

8. A method of controlling the resolution of an image formed on a substrate, comprising:

(a) providing an acidic substrate; and (b) applying an image to the substrate by imagewise directly applying upon the substrate a fluid composition comprising an ink-receiving layer compound and anionic surfactant, in which the dot size of the fluid composition on the substrate in the presence of the surfactant is less than the dot size of the fluid composition on the substrate in the absence of the surfactant, wherein an ink-absorbing layer is not applied to the substrate.

9. The method of claim 8, in which the ink-receiving layer compound is selected from the group consisting of poly (acrylic acid), poly(methacrylic acid), poly(maleic acid), poly(maleic anhydride), poly(fumaric acid), poly(fumaric anhydride), poly(styrene-co-acrylic acid), poly(styrene-co-maleic acid), poly(styrene-co-fumaric acid), polymers of ethylenically unsaturated sulfonic acid, polymers of sulfonated styrene, and mixtures thereof.

10. The method of claim 8, in which the anionic surfactant is selected from the group consisting of $F(CF_2CF_2)_{1-7}CH_2CH_2SCH_2CH_2CO_2^{-Li+}$, $(F(CF_2CF_2)_{1-7}CH_2CH_2O)_{1,2}PO(O^-NH_4^+)_{1,2}$, $C_{10}F_{21}SO_3^-NH_4^+$, and mixtures thereof.

11. A printing plate prepared by the process comprising:

(a) providing substrate; and (b) applying an image to the substrate by imagewise directly applying upon the substrate a fluid composition comprising at least one surfactant which is interfacially matched to the substrate, in which the dot size of the fluid composition on the substrate in the presence of the surfactant is less than the dot size of the fluid composition on the substrate in the absence of the surfactant, wherein an ink-absorbing layer is not applied to the substrate.

12. The printing plate of claim 11, in which the dot size of the fluid composition on the substrate in the presence of the surfactant is about or less than 90% of the dot size of the fluid composition on the substrate in the absence of the surfactant.

13. The printing plate of claim 11, in which the dot size of the fluid composition on the substrate in the presence of the surfactant is about or less than 80% of the dot size of the fluid composition on the substrate in the absence of the surfactant.

14. The printing plate of claim 11, in which the dot size of the fluid composition on the substrate in the presence of the surfactant is about or less than 70% of the dot size of the fluid composition on the substrate in the absence of the surfactant.

15. A printing plate prepared by the process comprising:

(a) providing a basic substrate; and (b) applying an image to the substrate by imagewise directly applying upon the substrate a fluid composition comprising an ink-receiving layer compound and a cationic surfactant, in which the dot size of the fluid composition on the substrate in the presence of the surfactant is less than the dot size of the fluid composition on the substrate in the absence of the surfactant, wherein an ink-absorbing layer is not applied to the substrate.

16. The printing plate of claim 15, in which the ink-receiving layer compound is selected from the group consisting of basic copolymers of styrene, polyamide, poly (vinylpyridine), basic copolymers of urethane, poly (dialkylaminoalkyl methacrylate), poly(2-vinylpyridine), poly(4-vinylpyridine), copolymers of 2-vinylpyridine, copolymers of 4-vinylpyridine, poly(ethylimidazolidone methacrylate), 2-pyridylethyl trimethoxysilane, copolymers of dimethylaminoethyl methacrylate/methyl methacrylate, terpolymers of dimethylaminoethyl methacrylate/methyl methacrylate/ethylimidazolidone methacrylate, copolymers of 4-vinylpyridine/methyl methacrylate/hydroxyethyl acrylate/ethyl acrylate, and mixtures thereof.

17. The printing plate of claim 15, wherein the cationic surfactant is $C_8F_{17}SO_2NHC_3H_6N^+(CH_3)_3I^-$.

18. A printing plate prepared by the process comprising:

(a) providing an acidic substrate; and (b) applying an image to the substrate by imagewise directly applying upon the substrate a fluid composition comprising an ink-receiving layer compound and anionic surfactant, in which the dot size of the fluid composition on the substrate in the presence of the surfactant is less than the dot size of the fluid composition on the substrate in the absence of the surfactant, wherein an ink-absorbing layer is not applied to the substrate.

19. The printing plate of claim 18, in which the ink-receiving layer compound is selected from the group consisting of poly(acrylic acid), poly(methacrylic acid), poly (maleic acid), poly(maleic anhydride), poly(fumaric acid), poly(fumaric anhydride), poly(styrene-co-acrylic acid), poly (styrene-co-maleic acid), poly(styrene-co-fumaric acid), polymers of ethylenically unsaturated sulfonic acid, polymers of sulfonated styrene, and mixtures thereof.

20. The printing plate of claim 18, in which the anionic surfactant is selected from the group consisting of $F(CF_2CF_2)_{1-7}CH_2CH_2SCH_2CH_2CO_2^-Li^+$, $(F(CF_2CF_2)_{1-7}CH_2CH_2O)_{1,2}PO(O^-NH_4^+)_{1,2}$, $C_{10}F_{21}SO_3^{-NH_4^+}$, and mixtures thereof.

21. A method of preparing a printing plate, the method comprising:

(a) providing a substrate; and (b) applying an image to the substrate by imagewise directly applying upon the substrate a fluid composition comprising at least one surfactant which is interfacially matched to the substrate, in which the dot size of the fluid composition on the substrate in the presence of the surfactant is less than the dot size of the fluid composition on the substrate in the absence of the surfactant, wherein an ink-absorbing layer is not applied to the substrate.

22. The method of claim 21, in which the dot size of the fluid composition on the substrate in the presence of the surfactant is about or less than 90% of the dot size of the fluid composition on the substrate in the absence of the surfactant.

23. The method of claim 21, in which the dot size of the fluid composition on the substrate in the presence of the surfactant is about or less than 80% of the dot size of the fluid composition on the substrate in the absence of the surfactant.

24. The method of claim 21, in which the dot size of the fluid composition on the substrate in the presence of the surfactant is about or less than 70% of the dot size of the fluid composition on the substrate in the absence of the surfactant.

25. A method of preparing a printing plate, the method comprising:

(a) providing a basic substrate; and (b) applying an image to the substrate by imagewise directly applying upon the substrate a fluid composition comprising an ink-receiving layer compound and a cationic surfactant, in which the dot size of the fluid composition on the substrate in the presence of the surfactant is less than the dot size of the fluid composition on the substrate in the absence of the surfactant, wherein an ink-absorbing layer is not applied to the substrate.

26. The method of claim 25, in which the ink-receiving layer compound is selected from the group consisting of basic copolymers of styrene, polyamide, poly (vinylpyridine), basic copolymers of urethane, poly (dialkylaminoalkyl methacrylate), poly(2-vinylpyridine), poly(4-vinylpyridine), copolymers of 2-vinylpyridine, copolymers of 4-vinylpyridine, poly(ethylimidazolidone methacrylate), 2-pyridylethyl trimethoxysilane, copolymers of dimethylaminoethyl methacrylate/methyl methacrylate, terpolymers of dimethylaminoethyl methacrylate/methyl methacrylate/ethylimidazolidone methacrylate, copolymers of 4-vinylpyridine/methyl methacrylate/hydroxyethyl acrylate/ethyl acrylate, and mixtures thereof.

27. The method of claim 25, in which the cationic surfactant is $C_8F_{17}SO_2NHC_3H_6N^+(CH_3)_3I^-$.

28. A method of preparing a printing plate, the method comprising:

(a) providing an acidic substrate; and (b) applying an image to the substrate by imagewise directly applying upon the substrate a fluid composition comprising an ink-receiving layer compound and anionic surfactant, in which the dot size of the fluid composition on the substrate in the presence of the surfactant is less than the dot size of the fluid composition on the substrate in the absence of the surfactant, wherein an ink-absorbing layer is not applied to the substrate.

29. The method of claim 28, in which the ink-receiving layer compound is selected from the group consisting of poly(acrylic acid), poly(methacrylic acid), poly(maleic acid), poly(maleic anhydride), poly(fumaric acid), poly (fumaric anhydride), poly(styrene-co-acrylic acid), poly (styrene-co-maleic acid), poly(styrene-co-fumaric acid), polymers of ethylenically unsaturated sulfonic acid, polymers of sulfonated styrene, and mixtures thereof.

30. The method of claim 28, wherein the anionic surfactant is selected from the group consisting of $F(CF_2CF_2)_{1-7}CH_2CH_2SCH_2CH_2CO_2^-Li^+$, $(F(CF_2CF_2)_{1-7}CH_2CH_2O)_{1,2}PO(O^-NH_4^+)_{1,2}$, $C_{10}F_{21}SO_3^{-NH_4^+}$, and mixtures thereof.

31. A method of controlling the spreading of a fluid composition on a substrate, the method comprising:

(a) providing a substrate; and (b) applying an image to the substrate by imagewise directly applying upon the substrate a fluid composition comprising at least one surfactant which is interfacially matched to the substrate, in which the dot size of the fluid composition on the substrate in the presence of the surfactant is less than the dot size of the fluid composition on the substrate in the absence of the surfactant, wherein an ink-absorbing layer is not applied to the substrate.

32. The method of claim 31, in which the dot size of the fluid composition on the substrate in the presence of the surfactant is about or less than 90% of the dot size of the fluid composition on the substrate in the absence of the surfactant.

33. The method of claim 31, in which the dot size of the fluid composition on the substrate in the presence of the surfactant is about or less than 80% of the dot size of the fluid composition on the substrate in the absence of the surfactant.

34. The method of claim 31, in which the dot size of the fluid composition on the substrate in the presence of the surfactant is about or less than 70% of the dot size of the fluid composition on the substrate in the absence of the surfactant.

35. A method of controlling the spreading of a fluid composition on a substrate, the method comprising:

(a) providing a basic substrate; and (b) applying an image to the substrate by imagewise directly applying upon the substrate a fluid composition comprising an ink-receiving layer compound and a cationic surfactant, in which the dot size of the fluid composition on the substrate in the presence of the surfactant is less than the dot size of the fluid composition on the substrate in the absence of the surfactant, wherein an ink-absorbing layer is not applied to the substrate.

36. The method of claim 35, in which the ink-receiving layer compound is selected from the group consisting of basic copolymers of styrene, polyamide, poly (vinylpyridine), basic copolymers of urethane, poly (dialkylaminoalkyl methacrylate), poly(2-vinylpyridine), poly(4-vinylpyridine), copolymers of 2-vinylpyridine, copolymers of 4-vinylpyridine, poly(ethylimidazolidone methacrylate), 2-pyridylethyl trimethoxysilane, copolymers of dimethylaminoethyl methacrylate/methyl methacrylate, terpolymers of dimethylaminoethyl methacrylate/methyl methacrylate/ethylimidazolidone methacrylate, copolymers of 4-vinylpyridine/methyl methacrylate/hydroxyethyl acrylate/ethyl acrylate, and mixtures thereof.

37. The method of claim 35, in which the cationic surfactant is $C_8F_{17}SO_2NHC_3H_6N^+(CH_3)_3I^-$.

38. A method of controlling the spreading of a fluid composition on a substrate, the method comprising:

(a) providing an acidic substrate; and (b) applying an image to the substrate by imagewise directly applying upon the substrate a fluid composition comprising an ink-receiving layer compound and anionic surfactant, in which the dot size of the fluid composition on the substrate in the presence of the surfactant is less than the dot size of the fluid composition on the substrate in the absence of the surfactant, wherein an ink-absorbing layer is not applied to the substrate.

39. The method of claim 38, in which the ink-receiving layer compound is selected from the group consisting of poly(acrylic acid), poly(methacrylic acid), poly(maleic acid), poly(maleic anhydride), poly(fumaric acid), poly (fumaric anhydride), poly(styrene-co-acrylic acid), poly (styrene-co-maleic acid), poly(styrene-co-fumaric acid), polymers of ethylenically unsaturated sulfonic acid, polymers of sulfonated styrene, and mixtures thereof.

40. The method of claim 38, wherein the anionic surfactant is selected from the group consisting of $F(CF_2CF_2)_{1-7}CH_2CH_2SCH_2CH_2CO_2^-Li^+$, $(F(CF_2CF_2)_{1-7}CH_2CH_2O)_{1,2}PO(O^-NH_4^+)_{1,2}$, $C_{10}F_{21}SO_3^-NH_4^+$, and mixtures thereof.

41. A method of forming an image on a substrate, the method comprising:

(a) providing a substrate; and (b) applying an image to the substrate by imagewise directly applying upon the substrate a fluid composition comprising at least one surfactant which is interfacially matched to the substrate, in which the dot size of the fluid composition on the substrate in the presence of the surfactant is less than the dot size of the fluid composition on the substrate in the absence of the surfactant, wherein an ink-absorbing layer is not applied to the substrate.

42. The method of claim 41, in which the dot size of the fluid composition on the substrate in the presence of the surfactant is about or less than 90% of the dot size of the fluid composition on the substrate in the absence of the surfactant.

43. The method of claim 41, in which the dot size of the fluid composition on the substrate in the presence of the surfactant is about or less than 80% of the dot size of the fluid composition on the substrate in the absence of the surfactant.

44. The method of claim 41, in which the dot size of the fluid composition on the substrate in the presence of the surfactant is about or less than 70% of the dot size of the fluid composition on the substrate in the absence of the surfactant.

45. An imaged substrate comprising:

(a) a substrate; and (b) a fluid composition directly applied imagewise directly to the substrate comprising at least one surfactant which is interfacially matched to the substrate, in which the dot size of the fluid composition on the substrate in the presence of the surfactant is less than the dot size of the fluid composition on the substrate in the absence of the surfactant, wherein an ink-absorbing layer is not applied to the substrate.

46. The imaged substrate of claim 45, in which the fluid composition is applied to the substrate by ink jetting.

47. A method of copying an image onto a medium, the method comprising:

(a) providing a substrate;

(b) applying an image to the substrate by imagewise directly applying upon the substrate a fluid composition comprising at least one surfactant which is interfacially matched to the substrate, in which the dot size of the fluid composition on the substrate in the presence of the surfactant is less than the dot size of the fluid composition on the substrate in the absence of the surfactant, wherein an ink-absorbing layer is not applied to the substrate;

(c) drying the fluid composition on the substrate;

(d) contacting the dried formed image with an ink, thereby coating the formed image with the ink, and (e) contacting the formed image coated with the ink with a medium capable of receiving the ink in the form of an image.

* * * * *